US008684180B2

(12) United States Patent
Lee et al.

(10) Patent No.: US 8,684,180 B2
(45) Date of Patent: Apr. 1, 2014

(54) COMESTIBLE PACKAGE WITH CLOSURE

(75) Inventors: Jonathan Lee, Milford, CT (US); Allen Aldridge, South Orange, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 867 days.

(21) Appl. No.: 12/663,456

(22) PCT Filed: Jun. 6, 2008

(86) PCT No.: PCT/US2008/007139

§ 371 (c)(1),
(2), (4) Date: Sep. 14, 2010

(87) PCT Pub. No.: WO2008/153953

PCT Pub. Date: Dec. 18, 2008

(65) Prior Publication Data

US 2011/0017632 A1 Jan. 27, 2011

Related U.S. Application Data

(60) Provisional application No. 60/942,640, filed on Jun. 7, 2007.

(51) Int. Cl.
*B65D 85/60* (2006.01)

(52) U.S. Cl.
USPC ..... 206/449; 206/525.1; 206/800; 229/87.07

(58) Field of Classification Search
USPC ..... 206/525, 525.1, 526, 449, 37, 460, 800; 229/87.07, 120.01, 120.011, 120.02, 229/120.09, 120.05
See application file for complete search history.

(56) References Cited

U.S. PATENT DOCUMENTS

| | | | | | |
|---|---|---|---|---|---|
| 1,875,197 | A | * | 8/1932 | Molins | 206/256 |
| 1,883,852 | A | * | 10/1932 | Medoff | 206/449 |
| 2,192,472 | A | | 3/1940 | Huston | |
| 2,311,137 | A | * | 2/1943 | Sunderhauf et al. | 229/122.32 |
| 2,319,560 | A | * | 5/1943 | Salfisberg | 206/474 |
| 2,859,866 | A | * | 11/1958 | Altenbern et al. | 206/362.4 |
| 3,698,544 | A | | 10/1972 | Growney | |
| 4,377,237 | A | | 3/1983 | Pawlowski | |
| 5,249,670 | A | * | 10/1993 | Simon | 206/773 |
| 5,699,957 | A | | 12/1997 | Blin et al. | |
| 7,159,717 | B2 | | 1/2007 | Aldridge et al. | |
| 7,325,686 | B2 | | 2/2008 | Aldridge | |
| 7,569,008 | B2 | * | 8/2009 | Aldridge et al. | 206/449 |
| 7,686,165 | B2 | * | 3/2010 | Aldridge et al. | 206/449 |
| 7,913,846 | B2 | * | 3/2011 | Aldridge et al. | 206/449 |
| 2003/0080020 | A1 | | 5/2003 | Kopecky | |
| 2005/0218198 | A1 | | 10/2005 | Cavero et al. | |
| 2005/0252817 | A1 | | 11/2005 | Aldridge | |
| 2006/0051457 | A1 | | 3/2006 | Bougoulas et al. | |
| 2007/0199849 | A1 | | 8/2007 | Aldridge | |

* cited by examiner

*Primary Examiner* — Jacob K Ackun
*Assistant Examiner* — Jenine Pagan
(74) *Attorney, Agent, or Firm* — Hoffmann & Baron, LLP

(57) ABSTRACT

A package includes a pair of opposed package end surfaces and a first package wall spaced from a second package wall and connected thereto by an end wall forming a first compartment for holding one or more product pieces. The first compartment has an opening. A cover extends from the first compartment and is movable between an open and closed position to selectively cover and uncover the first compartment opening. A closure is disposed at one of the opposed end surfaces and retains the cover in the closed position. The closure includes a first closure member on the cover and a second closure member on the container. The first closure member is selectively, operatively couplable to the second closure member.

13 Claims, 15 Drawing Sheets

COMESTIBLE PACKAGE WITH CLOSURE

The present application claims the benefit of U.S. Provisional Application Ser. No. 60/942,640 filed on Jun. 7, 2007 which is incorporated by reference herein in its entirety.

FIELD OF THE INVENTION

The present invention relates to packaging for products particularly comestibles. More particularly the present invention relates to a package for containing and dispensing products such as confectionary products including candy and gum which includes a closure for securing the packaging in the closed position.

BACKGROUND OF THE INVENTION

Chewing gum is currently available to consumers in a variety of different formats. These include stick gum, slab gum, pellet gum, extruded gum, and others. A variety of types of gum packaging also exist, including certain types of packaging used predominantly for one or the other of the gum formats. Slabs of gum have often been sold in foil packages. Originally, these slabs were arranged in a package in a side-to-side manner, perhaps including five to seven slabs per package. More recently, these slabs have been arranged within the foil packages in a face-to-face manner, allowing 15-20 slabs to be contained in a convenient package. Slabs are also offered in packages where the slabs lay side-by-side, and a cover moves between a closed and open position to permit dispensing. Such packaging typically has broad front and back surfaces on which product information can be placed.

Such packaging is currently popular and achieves satisfactory results. It has been discovered, however, that this approach does have certain drawbacks. The packaging typically includes a cover which is placed over the front or back of the packaging. The cover is typically secured by placing an end thereof into a slot formed on the front or back wall which the cover overlies. Accordingly, the cover does not extend to the bottom of the package and the cover does not envelop the surface. This presents a problem if a graphic is desired to be placed on the surface. The graphic has to be entirely on the cover or entirely on the surface, or the graphic has to be partially on the cover and the surface. Placing the graphic entirely on the cover or package surface limits the size of the graphic, and placing the image partially on the cover and surface requires that the cover and surface line up with each other the same every time otherwise the graphic will be distorted.

Accordingly, it would be desirable to provide a package with a reclosable cover that provides uninterrupted surfaces to accept indicia.

SUMMARY OF THE INVENTION

The present invention provides a package including a compartment for holding product and a cover securable in a closed position.

The present invention provides a package having opposed walls forming the compartment and the walls are connected by a bottom wall. The cover is securable in the closed position adjacent to the bottom wall.

The present invention provides a package including a pair of opposed package end surfaces and a first package wall spaced from a second package wall and connected thereto by an end wall forming a first compartment for holding one or more product pieces. The first compartment has an opening. A cover extends from the first compartment and is movable between an open and closed position to selectively cover and uncover the first compartment opening. A closure is disposed at one of the opposed end surfaces and retains the cover in the closed position. The closure includes a first closure member on the cover and a second closure member on the container. The first closure member is selectively, operatively couplable to the second closure member.

The present invention further provides a package including a front wall connected to a back wall by a bottom wall. The front, back and bottom walls define a first compartment therebetween. A cover extends from the back wall and is positionable over the front wall wherein the cover extends substantially to the bottom wall. A closure includes a tab extending from a distal end of the cover and a slot formed adjacent the bottom wall. The cover provides a uniform uninterrupted surface for receiving indicia thereon.

The present invention still further provides a package for containing one or more pieces of a comestible product including a first compartment and a second compartment and each compartment is formed to receive and contain one or more individual pieces of the comestible product. The first compartment is at least partially enclosed on five sides thereof, including a back wall, a front wall, a bottom wall, and a pair of lateral side walls. The second compartment is at least partially enclosed on five sides thereof, including a back wall, a front wall, a bottom wall, and a pair of lateral side walls. A cover flap is connected to the back wall of the first compartment. The first and second compartments are connected to each other by a bottom wall. The cover flap is selectably engagable with a first receiving slot located adjacent to the bottom wall.

The present invention also provides a package including a first package wall spaced from a second package wall and connected thereto by a first and second end wall forming a first and second compartment for holding one or more product pieces. The second package wall includes a removable portion, wherein removal thereof provides access to the first and second compartments.

The present invention still further provides a package including a compartment having an interior adapted to hold product pieces. A cover extends from a first end of the compartment. The cover includes a recess for receiving therein the compartment. The cover has a base wall and an end wall extending from the base wall. A first closure member is disposed on the cover adjacent a junction between the base wall and the end wall. A second closure is formed on the compartment and is operably engagable with the first closure to selectively secure the cover in a closed position.

DETAILED DESCRIPTION OF THE PREFERRED EMBODIMENTS

The present invention provides a package for containing and dispensing products. In particular, the present invention may be used for containing and dispensing confectionary products such as gum pieces, hard candy and other comestibles. Although the particular embodiments shown herein are employed to contain gum pieces, it may be appreciated that the package may contain any type of product. Such products may also include other confectionary products such as gum in various sizes and shape, such as sticks, slabs, pillows, pellets and the like, as well as other confectionary products such as candy, chocolate and the like. Products could include a plurality of pieces or be a single unitary product. Also non-confectionary products may be employed.

The product pieces held in the packaging of the present invention may be a size, shape, or configuration including slabs, pellets, and sticks. The slabs may be arranged in a side-by-side array or in a face-to-face array. While individual discrete slabs are shown herein, it is contemplated that the package may contain one or more products having portions thereof that can be broken away or detached for use. Moreover, the product pieces may be unwrapped or individually wrapped. It is within the contemplation of the present invention that other products could be contained in the package.

Figure 1:
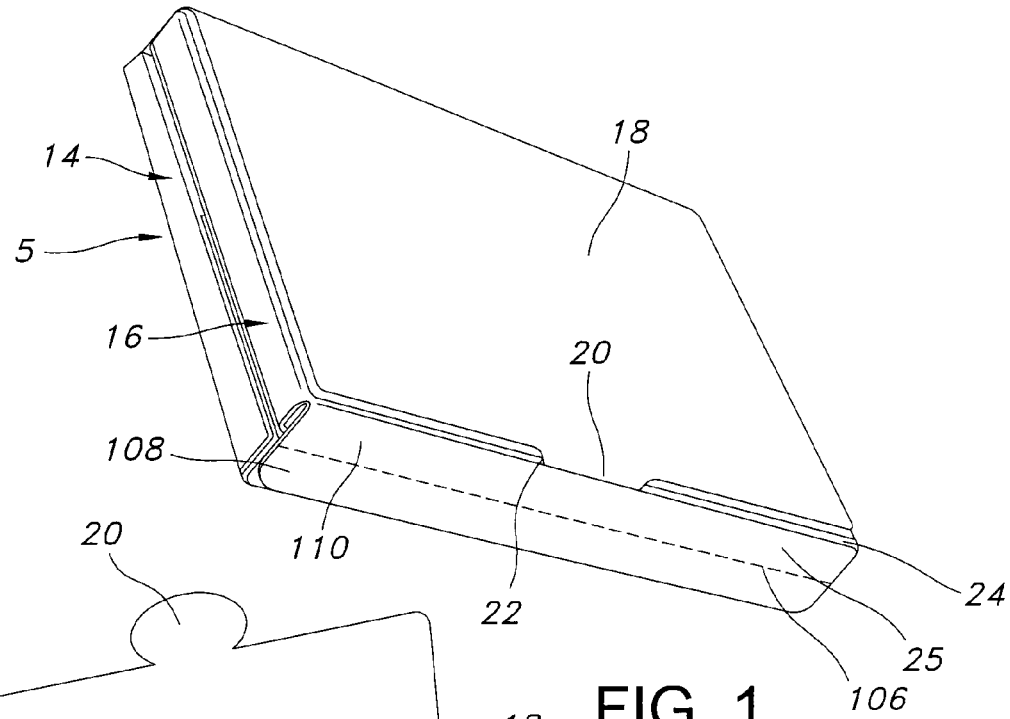
FIG. 1 is a prospective view of a package of the present invention shown in the closed position.

With reference to FIGS. 1 through 6, in one embodiment of the present invention the package 5 may employ an upper compartment 14 and a lower compartment 16 for containing a consumable product 28, such as pieces of chewing gum. The compartments 14 and 16 are originally provided in an attached manner and folded together to place one facing and overlying the other. A cover flap 18 extends from the upper compartment 14 having an end 20 laid over a receiving slot 22 formed between a back panel 24 of the lower compartment 16 and a package bottom wall 25. A consumer can tuck this end 20 into the slot 22 to form a compact package 5, such as is shown in FIG. 1. In the folded closed position the cover flap 18 forms a front of the package. In this disclosure, the terms front and back when referring to the package are used for clarity of description purposes only and such use is not intended to be limiting since either side of the package could be designated the front or the back. The back panel 24 and the cover flap 18 of the package when in the closed position provide smooth uninterrupted broad surfaces upon which indicia may be printed or applied.

Figure 2:
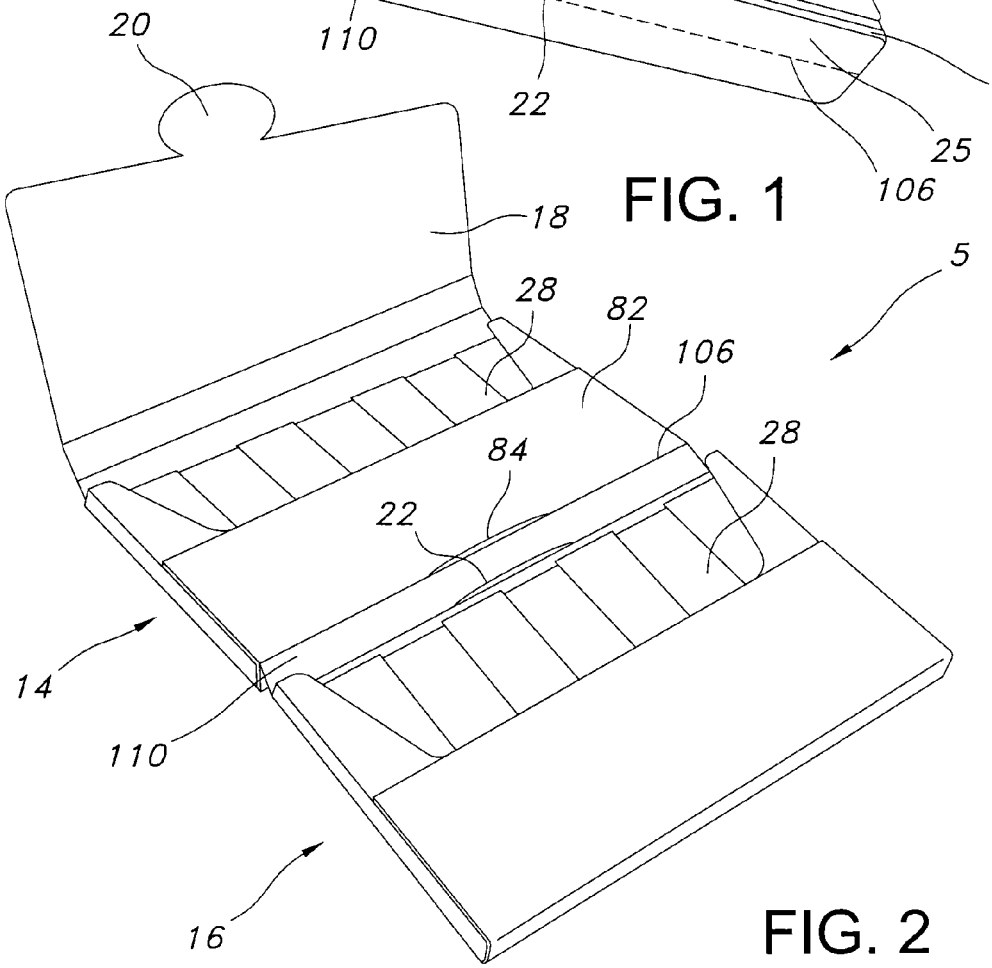
FIG. 2 is a prospective view of the package of FIG. 1 shown in the open position.
Figure 3:
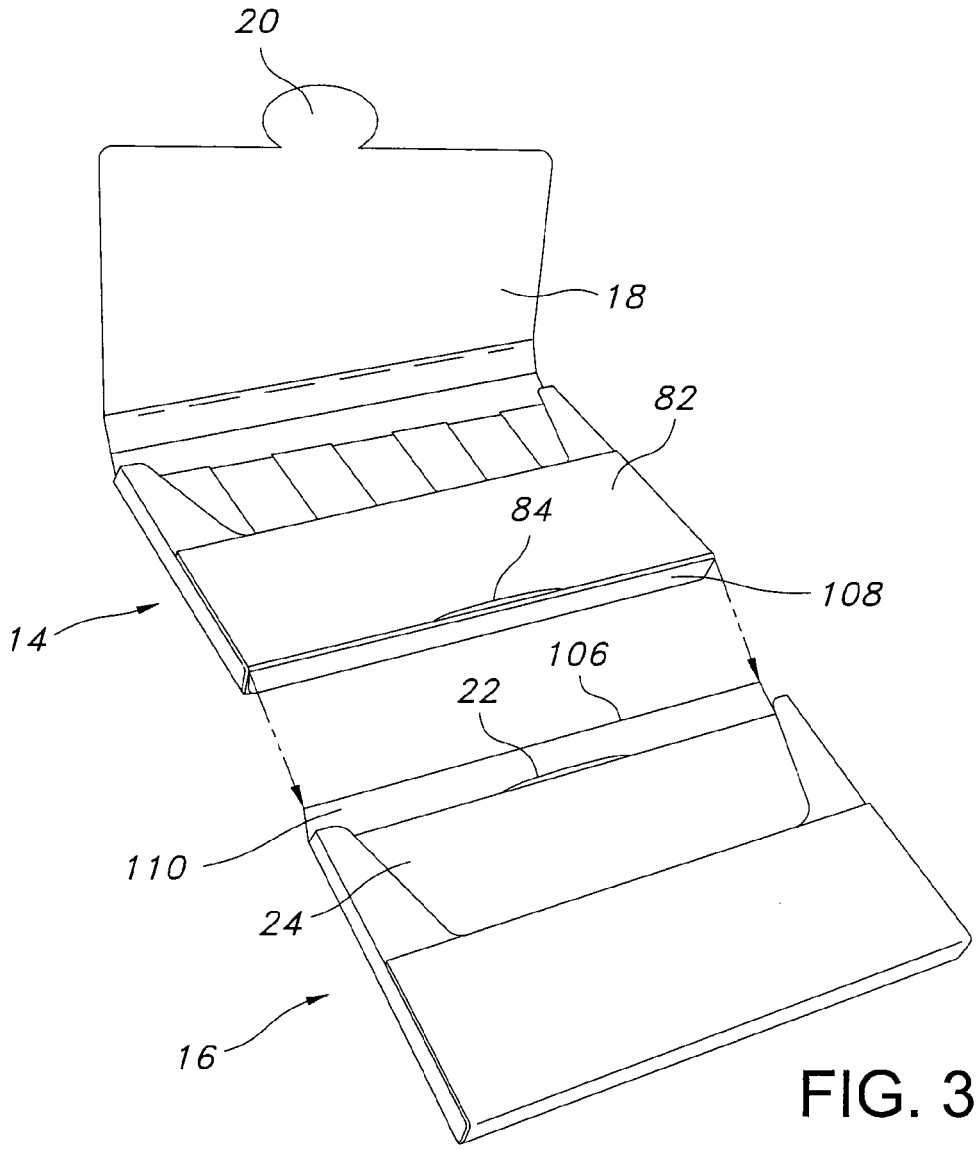
FIG. 3 is a prospective view of the package of FIG. 2 showing the separation of a first and second compartment.
Figure 4:
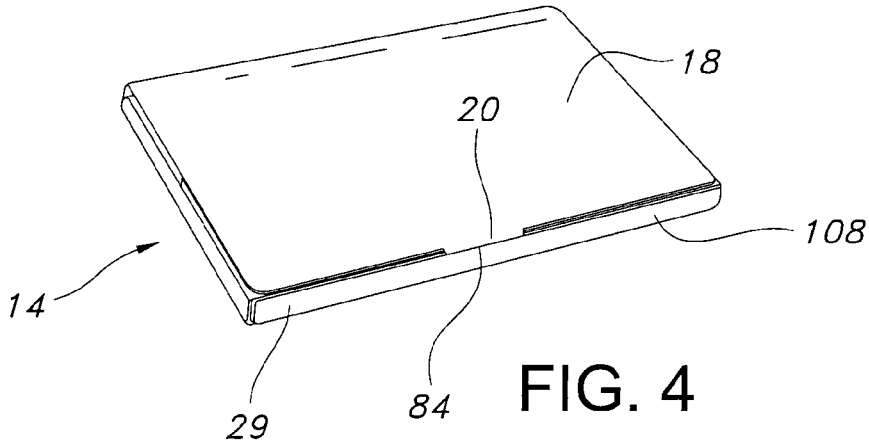
FIG. 4 is a perspective view of the package in the closed position with a compartment removed.

Once purchased, a clear film over-wrap (not shown) can be removed from the package 5 so that the customer can lift the cover flap 18 to allow the lower compartment 16 to swing down into the position shown in FIG. 2. In this position, the customer can remove slabs 28 of the product as desired or share with others. The package 5 can then be returned to its original configuration as shown in FIG. 1. If the customer wishes, they can consume the slabs 28 of gum from the lower compartment 16 first and then, once emptied, separate the compartments 14 and 16 from each other by tearing along a perforated score line 106 as shown in FIGS. 1 and 3. Next, if desired, the customer can fold the cover flap 18 down over the upper compartment 14 and tuck the end 20 of the cover flap 18 into a receiving slot 84 formed in the bottom 29 of upper compartment 14 (as shown in FIG. 4) and continue to use the upper compartment 14 of the package 5 in this manner until all the product is consumed.

Figure 5:
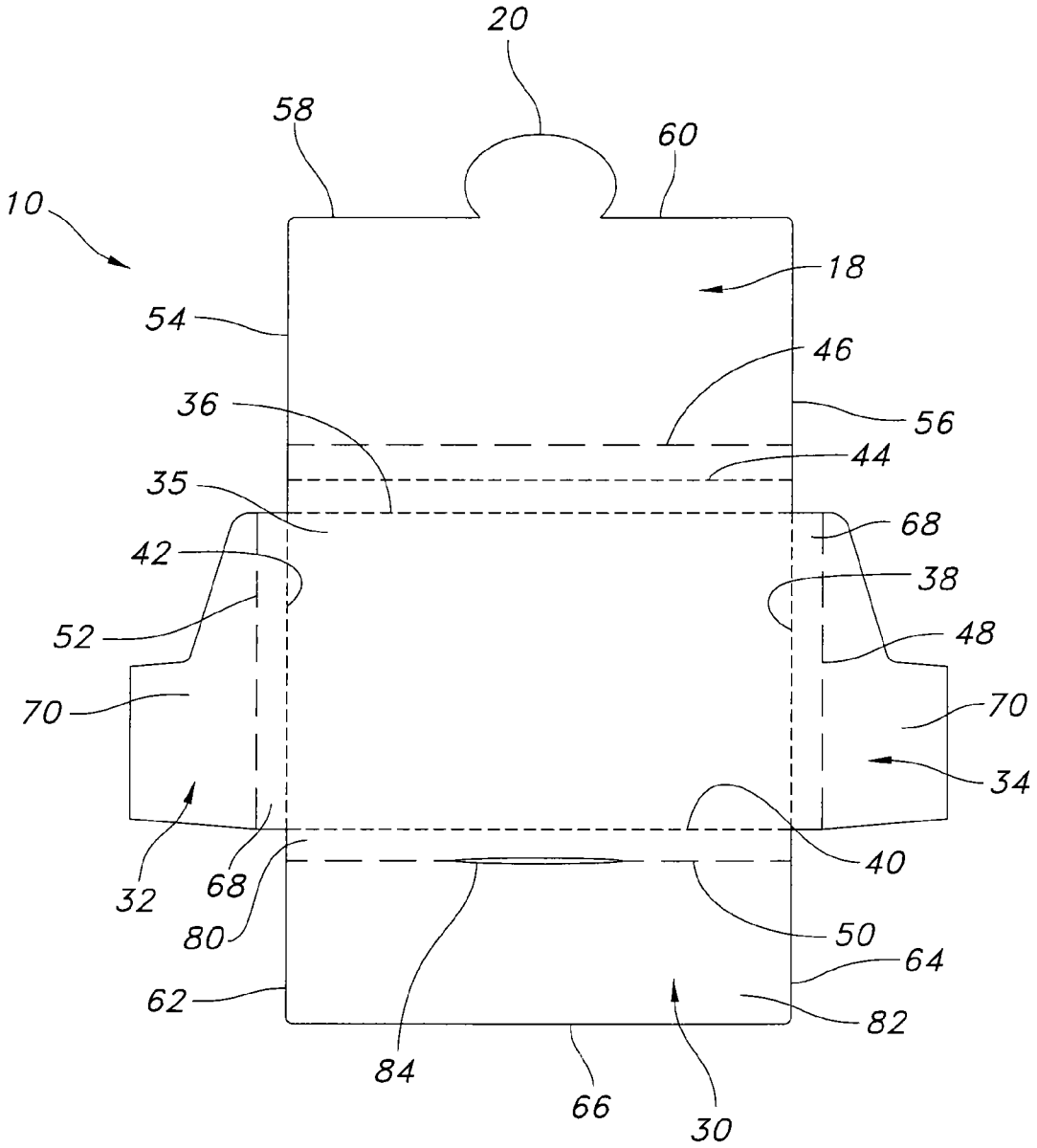
FIG. 5 is a plan view of a first unfolded blank used to form an upper compartment and cover flap of the package of FIG. 1.
Figure 6:
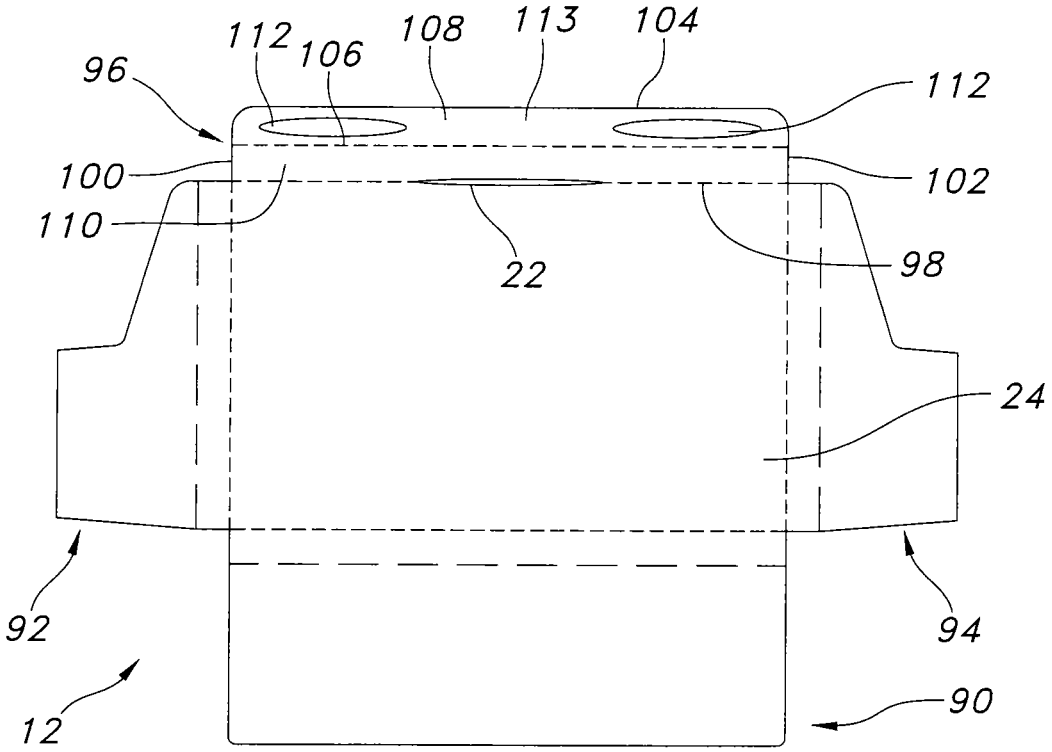
FIG. 6 is a plan view of a second unfolded blank used to form the lower compartment of the package of FIG. 1.

With reference to FIGS. 5 and 6, in one embodiment of the present invention the package 5 may employ two paperboard blanks 10 and 12, scored in a manner to be folded so that each form a compartment for containing a consumable product 28, such as chewing gum. One of the blanks forms the upper compartment 14, while the other of the blanks forms the lower compartment 16. One blank (or compartment) is adhered to the other in a manner to allow one to be easily separated from the other by tearing along a perforation. As shown in FIG. 5, the first paperboard blank 10 has the cover flap 18 extending from one side thereof and a bottom flap 30 extending from an opposite side thereof. On the lateral sides of the first paperboard blank 10, a pair of lateral side flaps 32 and 34 extend in opposite directions. The remaining central portion of the first paperboard blank 10 forms a back panel 35 for the upper compartment 14. The first paperboard blank 10 may be composed of SBS (solid bleach sulfate) paperboard, in part because of the good folding properties of this material. Alternatively, the compartments 14 and 16 could be composed of some other suitable material, such as polyvinyl chloride (PVC). The paperboard material may have a white clay emulsion coating on an outside surface thereof and no coating on an inside surface thereof. The coating enhances the ability to print on the paperboard, which may occur prior to the cut, scoring, and assembly steps described below. There could also be a laminate of holographic material added to the printed side.

As can be seen in FIG. 5, the cover flap 18 is generally four-sided with one side being defined along the score line 36, two orthogonal lateral sides 54 and 56 and a top side having segments 58 and 60 that extend from the lateral sides 54 and 56 and meet at the tab-like end 20 of the cover flap 18. The bottom flap 30 includes a side that is defined by the score line 40, a pair of orthogonal lateral sides 62 and 64 and a bottom side 66 that is orthogonal to the lateral sides 62 and 64. The lateral side flaps 32 and 34 are mirror images of each other, so only lateral side flap 32 will be described in detail. The lateral side flap 32 includes a generally rectangular portion between the score lines 42 and 52 that will form a side panel 68 to the upper compartment 14. The remaining portion of the lateral side flap 32 forms a front wing 70 after the lateral side flap 32 is folded along score lines 42 and 52. The front wing includes a generally rectangular section and a generally triangular section located above the generally rectangular section.

As can be appreciated in FIG. 5, the first paperboard blank 10 is scored in multiple places along score lines 36, 38, 40, 42, 44, 46, 48, 50, and 52. Lines 36, 38, 40, 42, and 44 are regular score lines, while lines 46, 48, 50, and 52 are cut score lines. A regular score line is a crease formed in the paperboard using a tool having male and female matching channels that are applied to the paperboard blank 10 from opposite sides to form a V-shape in the material. A cut score line differs from a regular score line in that the cut score line is not only scored in the manner described above, but small slits are also cut entirely through the material at spaced apart locations along the line. A cut score creates a line that is easier to fold than does a regular score line. The drawback is that a cut score line does not have as neat an appearance as a regular score line when the folded package is viewed externally by a consumer. For this reason, lines that will be visible when the package is fully assembled, as shown in FIG. 1, are regular score lines while the remaining fold lines may be cut score lines. It is within the contemplation of the present invention that the use of either cut or regular score lines may be varied from that set forth above in order to achieve desired folding and construction.

Blank 10 may be folded in a manner similar to that disclosed in U.S. patent application Ser. No. 11/803,345 filed May 14, 2007 and U.S. Pat. No. 7,159,717 issued Jan. 9, 2007, which are both incorporated by reference herein in their entirety. As is illustrated in FIG. 5 the lateral side flaps 32 and 34 are folded along score lines 42, 52, 38, and 48 to form the front wings 70, while the bottom flap 30 is folded along score lines 40 and 50 to form a bottom wall 80 and a front panel 82. Adhesive (not shown) can then be applied to the surface of the front wings facing toward the front panel and/or to the portion of the front panel facing toward the front wings to affix the front panel 82 to the front wings 70. In this manner, the upper compartment 14 is formed from the first paperboard blank 10.

The receiving slot 84 may be formed along folded line 50 (FIG. 5). It is within the contemplation of the present invention that the receiving slot 84 may be formed on front panel 82 adjacent fold line 50 or on bottom wall 80. In FIG. 4, the upper compartment 14 is shown with the end 20 of the cover flap 18 inserted into the receiving slot 84 of the upper compartment 14. As can be appreciated, it is intended that this slot 84 would only be used to close the package when the lower compartment 16 has been removed.

With reference to FIG. 6, the second paperboard blank 12 is similar to the first paperboard blank in many respects. It is composed of the same material and has a clay coating on one side to enhance the ability to print material thereon. The second paperboard blank 12 also includes a bottom flap 90 and lateral side flaps 92 and 94 that are identical to the bottom flap 30 and lateral side flaps 32 and 34 of the first paperboard blank 10. The primary differences between the second paperboard blank 12 and the paperboard blank 10 relate to a connecting flap 96 on the second paperboard blank 12 and the receiving slot 22 on the lower compartment 16.

The connecting flap 96 of the second paperboard blank 12 is generally rectangular with one side being defined by a regular score line 98 on a bottom side thereof, a pair of lateral sides 100 and 102, and a top side 104. A perforated score line 106 divides the connecting flap 96 into an upper portion 108 and a lower portion 110. The perforated score line 106 includes a score and a series of perforations that are close enough together to only leave that amount of paper necessary to hold the portions 108 and 110 together until separation is desired. When desired, this perforated score line 106 enables detachment so that portions 108 and 110 can be fairly easily separated by the customer. FIG. 3 shows the two compartments 14 and 16 after they have been separated from each other along the perforated score line 106. The upper portion 108 of the connecting flap 96 includes adhesive 112 applied to an inner surface thereof for attachment to the outer surface of the bottom wall 80 of the upper compartment 14. As shown in FIG. 6, a segment 113 of the connecting flap portion 108 may be kept free of adhesive. Therefore, when the portion 108 is attached to the bottom wall 80 of the upper compartment the unadhered portion will form receiving slot 22 as shown in FIGS. 1 and 2.

When the first 10 and second 12 blanks are assembled together, the back panel of the lower compartment 16 and the front panel of the upper compartment 14 would tend to hang in generally the same plane when in the open position of FIG. 2 and with the upper compartment held vertically, allowing the lower compartment to hang downwardly therefrom. The lower portion 110 of the connecting flap could then be sized to have a height approximately equal to a side wall of the lower compartment.

Referring again to FIGS. 5 and 6, the lower compartment 16 also differs from the upper compartment 14 in the location and orientation of the receiving slot 22 on the lower compartment 16 relative to the receiving slot 84 on the upper compartment 14. The receiving slot 22 in the lower compartment 16 is formed along the fold line 98. Alternatively, the slot 22 may be formed along the top of back panel 24 adjacent fold line 98 or along connecting flap lower portion 110. When the lower compartment 16 is folded up adjacent to the upper compartment 14 in the orientation shown in FIG. 1, then the end 20 of the cover flap 18 may be inserted in the receiving slot 22. Other than the differences already described with regard to the connecting flap 96, the folding and attachment of the lateral side flaps 92 and 94 and the bottom flap 90 to each other is performed in a similar manner to that described above in conjunction with the upper compartment 14.

Figure 7:
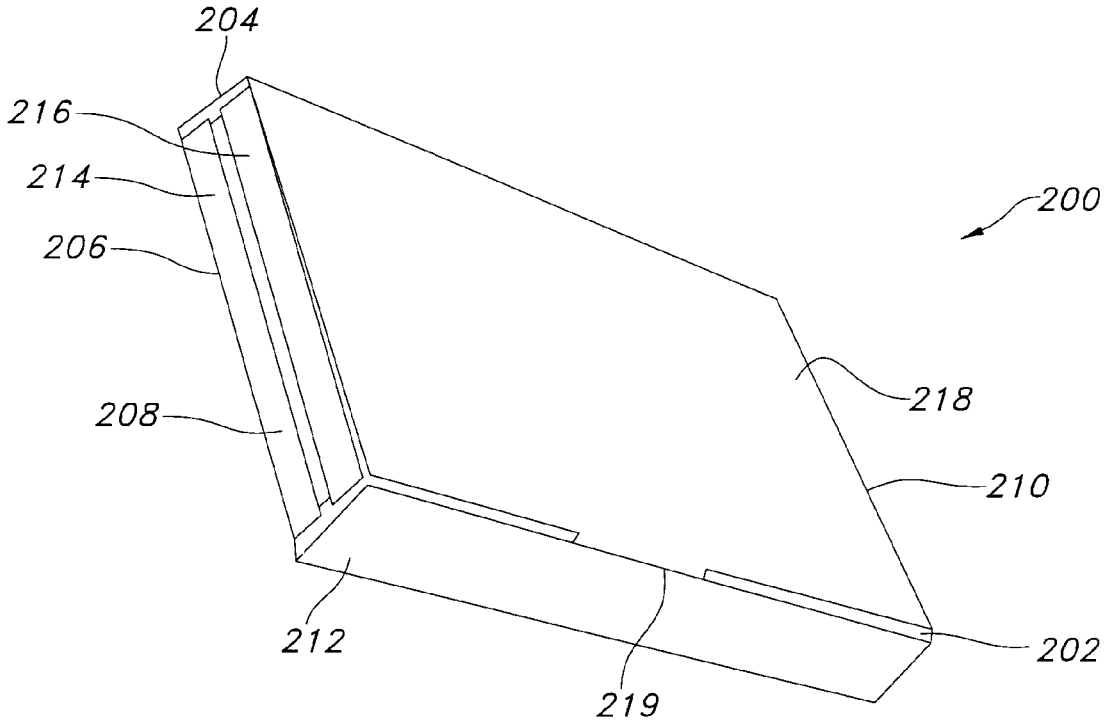
FIG. 7 is a perspective view of an alternative embodiment of a package of the present invention shown in the closed position.
Figure 8:
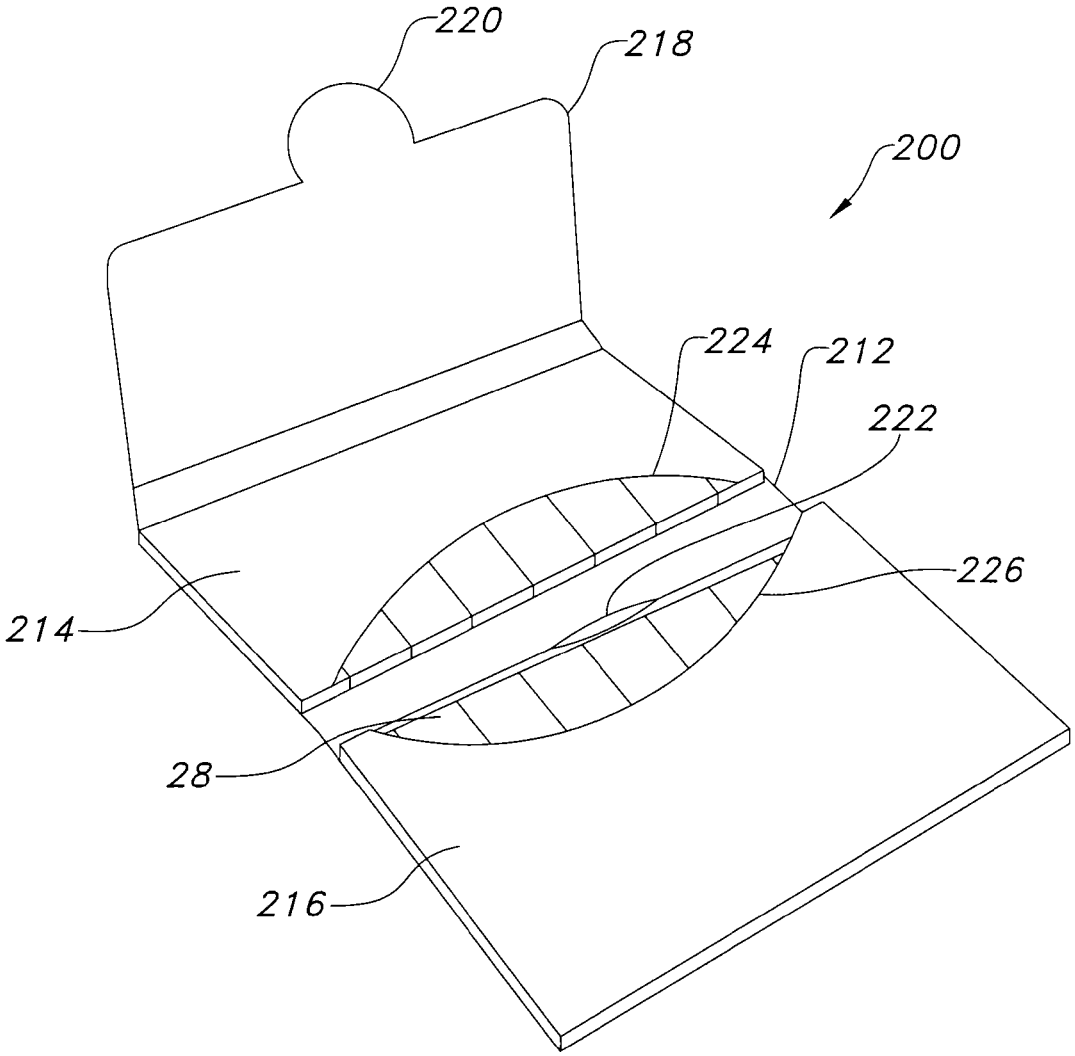
FIG. 8 is a prospective view of the package of FIG. 7 shown in the open position.
Figure 9:
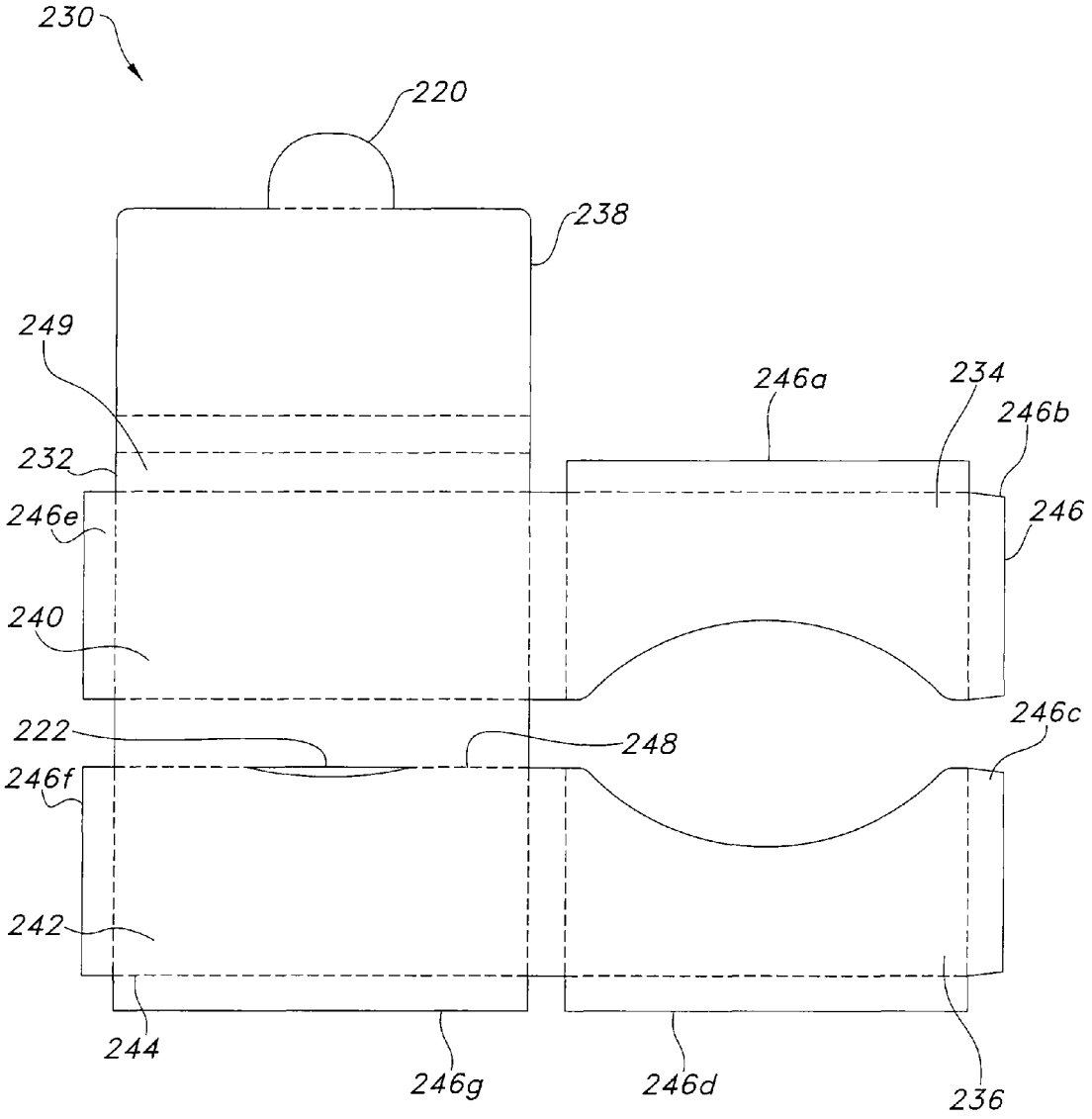
FIG. 9 is a plan view of an unfolded blank used to form the package of FIG. 7.

An alternative embodiment of the present invention is shown in FIGS. 7-9, A package 200 is used to contain and dispense a plurality of product pieces 28 which are contained within the package 200. In a closed position shown in FIG. 7, package 200 includes a front 202, a top 204, a back 206, opposed sides 208 and 210, and bottom 212.

As in the previously described embodiment, package 200 includes first and second compartments 214 and 216 for holding the product pieces 28. The first and second compartments are connected to each other and foldable together to place one in opposed facing relationship to the other as shown in FIG. 7. A cover flap 218 extending from the first compartment 214 folds over the second compartment 216 and package front 202. While the package 200 is shown in a generally rectangular configuration, it is within the contemplation of the present invention that the package could be any number of shapes or configurations.

The package includes a closure 219 including a closure tab 220 extending from the end of the cover flap 218. Closure 219 may further include a receiving slot 222 disposed on or adjacent to the bottom 212 of the package. Preferably, receiving slot 222 is formed along the transition between the package bottom 212 and the second compartment 216. A close fit between the tab and the slot releasably retains the tab therein.

It is also within the contemplation of the present invention, that the package may be initially secured in the closed position by an adhesive. This adhesive may be the type that can be overcome without resulting in the destruction of the package. Subsequent securement in the closed position would be by way of the closure 219.

In the closed position, the cover flap 218 extends all the way to the package bottom 212 as shown in FIG. 7. Therefore, a smooth uninterrupted front surface is created, permitting indicia to be printed or otherwise applied thereon. This creates a clean attractive appearance and permits indicia, such as graphics, to be applied without concerns of having two surfaces meeting precisely to create uninterrupted appearance. The package back 206 may also be a smooth an uninterrupted surface suitable for accepting indicia.

Package 200 may be opened by lifting the cover flap 218 up away from the second compartment 216, which removes closure tab 220 from slot 222. The second compartment 216 may then be folded away from the first compartment 214. Upon opening the package 200, an opening 224 to the first compartment and an opening 226 to the second compartment are exposed. Accordingly, the product 28 stored within the compartments may be accessed. In the open position, the first and second compartments are offset longitudinally from each other with the second compartment 216 extending from the first compartment 214. In this embodiment, openings 224 and 226 to the first and second compartments may face each other as shown in FIG. 8.

The package may preferably be formed of a unitary piece of material such as paperboard or other material as described above. With reference to FIG. 9, the package 200 may be formed from a precut blank 230 which is folded to form the package. Blank 230 may include a main body 232 having first 234 and second 236 side flaps extending generally orthogonally therefrom. The first 234 and second 236 side flaps may extend from the same side of the main body 232 or alternatively each may extend from a different side edge of the main body.

Main body 232 may include a cover flap portion 238, a first compartment back wall portion 240 and a second compartment back wall portion at 242. A series of fold lines 244 may be formed in the blank 230 in order to facilitate folding thereof. Fold lines may include creases formed in the package or may include perforations as in a manner known in the art. The blank 230 may further include a plurality of securement tabs 246*a-g* extending from the various elements which are used to receive adhesive and secure the various elements in place. The first side flap 234 includes a first 246*a* and second 246*b* securement tab extending from the edges thereof. Second side flap 236 includes a third 246*c* and fourth 246*d* securement tabs. The main body 232 includes a fifth securement tab 246*e* extending from the first compartment back wall portion 240. A sixth 246*f* and seventh 246*g* securement tab extend from the second compartment back wall portion 242 of the main body.

The receiving slot 222 may be formed along a fold line 248 disposed adjacent the top of the second compartment back wall portion 242. Alternatively, it may be formed adjacent thereto. Receiving slot 222 is sized to receive therein cover flap tab 220 which extends from cover flap portion 238.

In order to form the package 200, the first and second side flaps 234 and 236 may be folded over such that they are in opposed space relation to the main body 232. The securement tabs 246*a-g* may also be folded generally at a 90 degree angle and the adjoining securement tabs may be secured together by adhesive. Securement tab 246*a* extending along the edge of the first side flap may be secured to a base 249 of the cover flap 238 to form a bottom of the first compartment 214. The securement tab 246*d* extending from the second extension and securement tab 246*g* extending from the second container back wall portion may be secured together to form the bottom wall of the second container 216. Securement tabs 246*b* and 246*e* overlap each other and may be secured to each other to form a side wall of first compartment 214. Likewise, securement tabs 246*c* and 246*f* may be secured together to form a side wall of second compartment 216.

Figure 10:
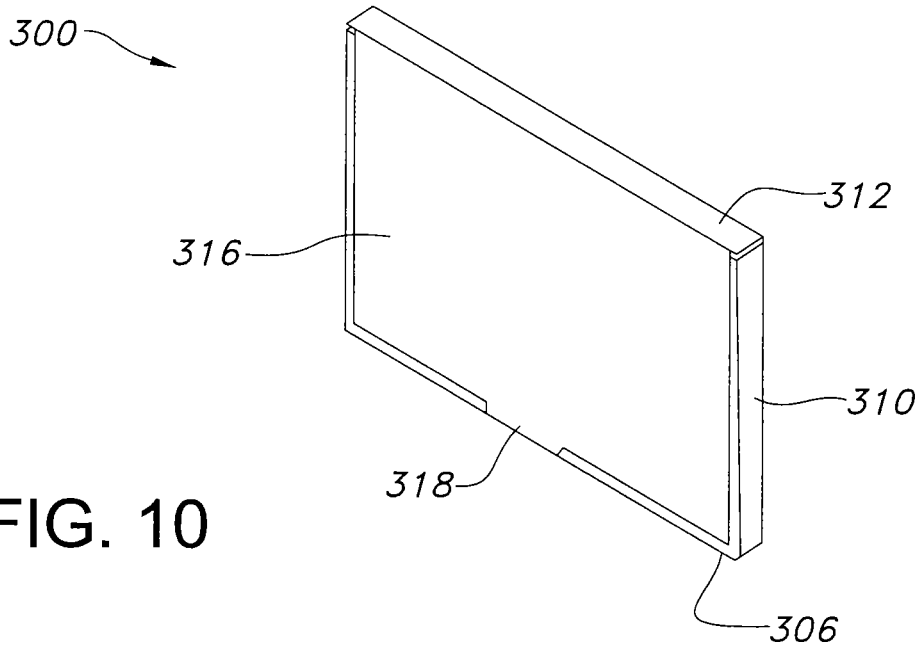
FIG. 10 is a perspective view of a further alternative embodiment of a package of the present invention shown in the closed position.
Figure 11:
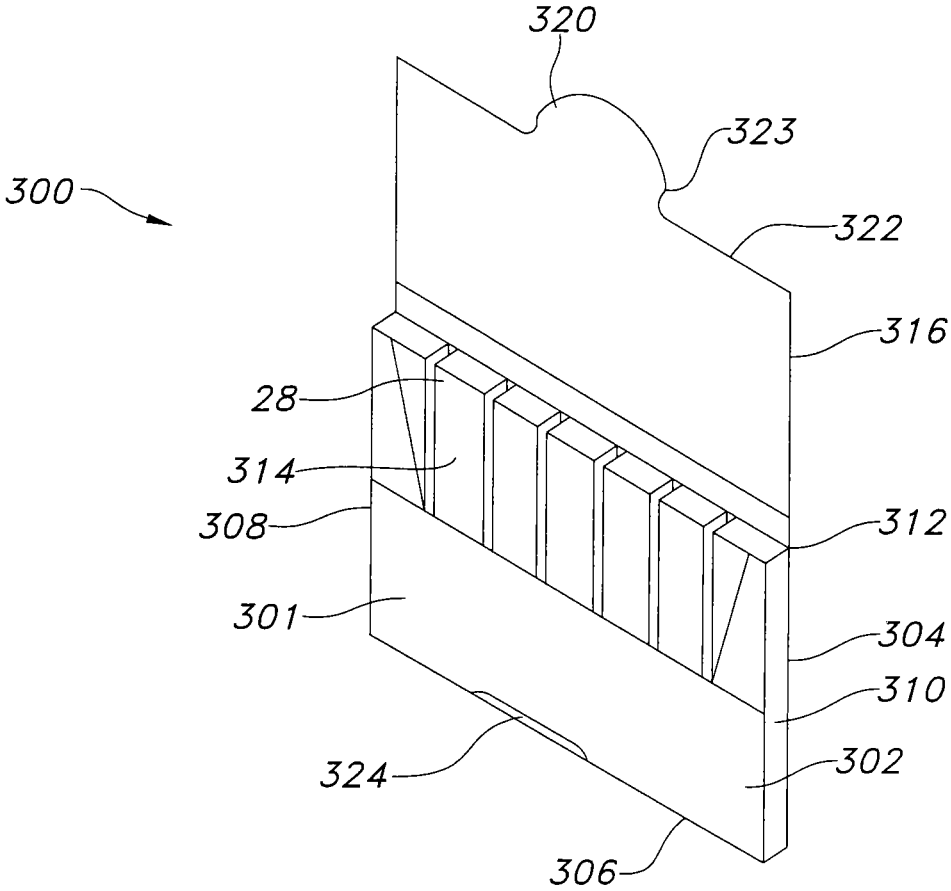
FIG. 11 is a perspective view of the package of FIG. 10 shown in the open position.
Figure 12:
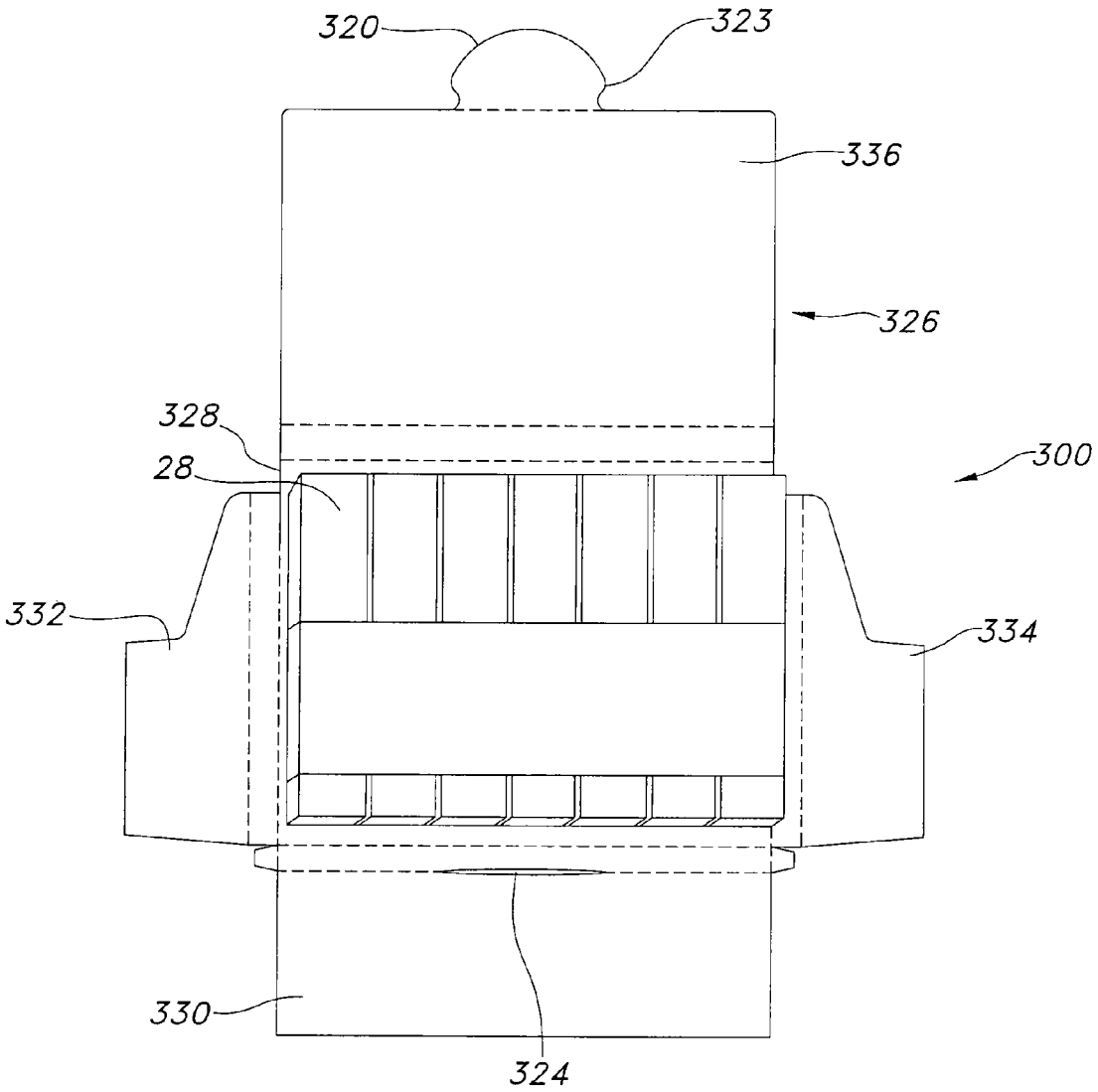
FIG. 12 is a plan view of the package of FIG. 10 shown in an unfolded position.

A further alternative embodiment is shown in FIGS. 10-12. Package 300 includes a compartment 301 configured to hold an array of product pieces 28. The package 300 includes a front wall 302, an opposed back wall 304, a bottom wall 306, and opposed side walls 308 and 310. As will be described in further detail hereinbelow, the package 300 is formed from die cut paperboard blank, which is folded in a well known manner to form the configuration shown in FIGS. 10 and 11. The package 300 may be folded such that it provides an open upper end 312 which defines a dispensing opening 314. The back wall 304 includes an upwardly extending foldable cover 316 which may be folded over the open upper end to close the opening 314 and contain the product 28 within the package 300. With the cover in the closed position, it forms the front of the package.

The package 300 may include a closure 318 for releasably retaining the package in the closed position. Closure 318 may include a tab 320 extending from a cover distal edge 322. Closure 318 may further include a receiving slot 324 positioned between the bottom wall 306 and front wall 302. Slot 324 could alternatively be formed entirely on the bottom wall 306 or on the front wall 302 adjacent the bottom wall 306. The slot 324 allows the tab 320 to be inserted therein for reclosing purposes. In one embodiment, closure tab 320 may include projections 323 which extend outwardly giving the tab a width slightly greater than the slot. The tab 320 may then deflect upon insertion into the slot 324 and return to the original configuration once in the slot, thereby retaining the tab therein.

Additionally, it is contemplated that the package may be initially provided to a consumer with the cover 316 adhesively secured to the front wall 302 to help maintain the cover in the closed position. Once the adhesive securement is removed to dispense the first product piece, the cover 316 may be secured in the closed position by inserting the tab 320 into the slot 324 as shown in FIG. 10. The cover 316 extends to the bottom of the package and is secured adjacent the bottom wall 306. Accordingly, the front of the package 300 is substantially completely covered by the continuous cover 316. Therefore, an uninterrupted front surface of the package is presented to receive indicia such as product identification or information. The back of the closed package also presents a uniform uninterrupted surface for such indicia.

It is contemplated that the array of product pieces 28, such as slabs of gum, will be removably, retentively supported within the package 300 so that it permits easy removal of one or more gum slabs while maintaining the remainder of the gum slabs in the package. Furthermore, it is contemplated that the technique for releasably supporting the product pieces 28 within the package 300 will permit the pieces to maintain their position within the package even after removal of one or more of the adjacent product pieces so as to prevent them from tilting or falling over in the package or falling out from the package. The support of the product pieces is more fully described in U.S. patent application Ser. No. 11/726,702 filed on Mar. 22, 2007 and U.S. Pat. No. 7,325,686 issued Feb. 5, 2008, which are both incorporated by reference herein in their entirety.

The package 300 may be formed from a die cut paperboard blank 326 which may be folded from a flat configuration shown in FIG. 12 into the configuration shown in FIGS. 10 and 11. The blank 326 may include a back wall 328, a foldable front wall 330, foldable side walls 332 and 334 and a foldable cover 336. The package 300 supports the array of product pieces 28 against the interior surface of back wall 328. The side walls 332 and 334 may be folded together and the front wall 330 folded up. The front wall 330 may be adhered to the side walls 332, 334. The folding of the walls forms the compartment 301 which holds the product.

With reference to FIGS. 13-16, a further alternative embodiment of the package for holding one or more product pieces 409 is shown. Package 400, when in a closed position, includes a front surface 402 and an opposed back surface 404 bounded by side walls 406, forming a substantially closed package. The package 400 includes two principal sections including a product holding compartment 408 for retaining product 409 and a cover 410. The compartment 408 is bounded by a front wall 412 and a back wall 414 with two side walls 416, 418 extending therebetween. The walls form an interior 420 for holding the product 409. The compartment has an opening 419 to permit the product to be inserted and removed therefrom. The front wall 412 may include a recessed edge 420 in order to increase the size of the opening 419, thereby providing greater access to the retained product 409. Extending from holding compartment bottom 422 is the cover 410.

Figure 13:
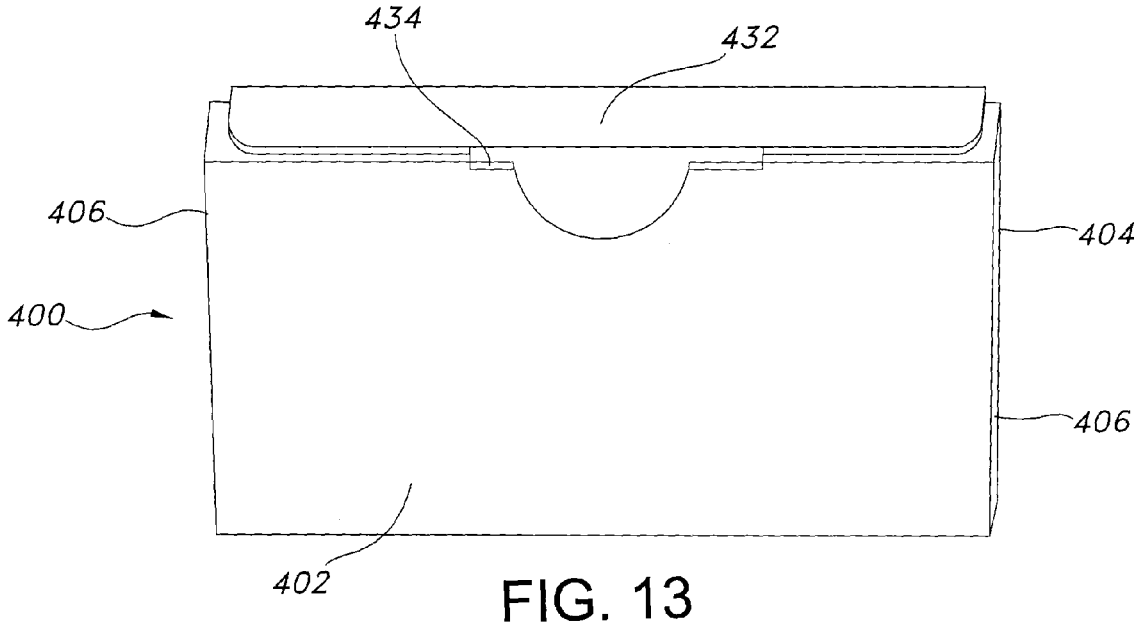
FIG. 13 is a perspective view of an additional alternative embodiment of a package of the present invention.
Figure 16:
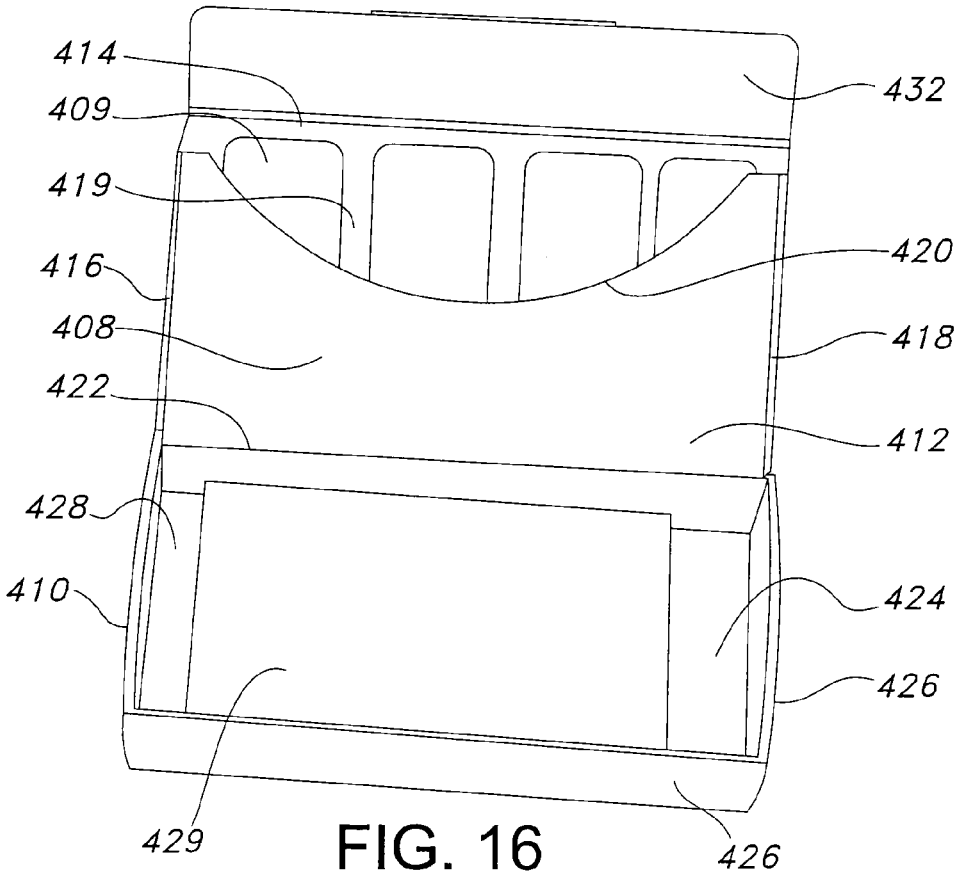
FIG. 16 is a perspective view of the package of FIG. 13 shown in the open position.

The cover 410 is rotatable with respect to the compartment 408 between an open and closed position. The cover 410 may include a base wall 424 bounded by upward extending edge walls 426. The base and edge walls form a recess 428 in which the compartment 408 is contained when the package 400 is in the closed position as shown in FIG. 13. Accordingly, the cover 410 completely surrounds the compartment opening 419 such that the product 409 is securely retained in the package 400 and containments are kept out. The cover 410 may include a pad 429 formed of a resilient material disposed in the recess 428 (FIG. 16). The pad 429 may engage the product pieces 409 when the cover is closed which helps protect the product pieces 409 from damage and maintains them in place.

Figure 14:
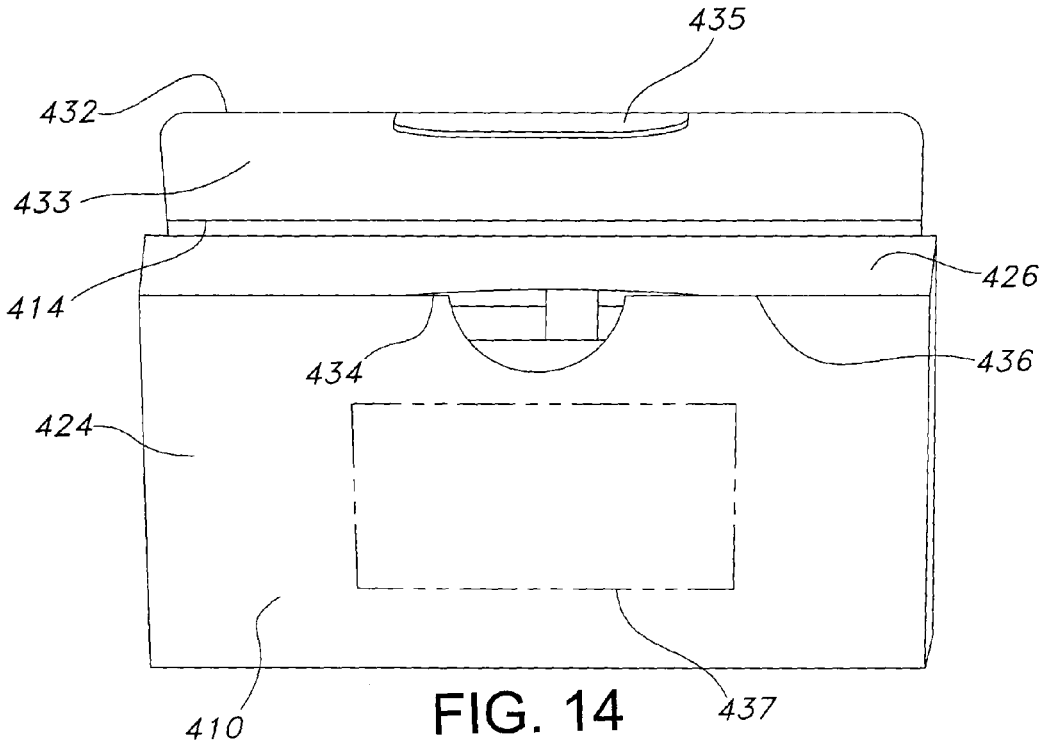
FIG. 14 is a perspective view of the package of FIG. 13 shown in a partially opened position.

With reference to FIG. 14, extending from the compartment back wall 414 is a first closure element 432. A second closure element 434 is formed on the cover 410 at a junction 436 between the base wall 424 and one of the upstanding edge walls 426. When the cover 410 is moved into the closed position, the first closure member 432 may be rotated such that it comes into alignment with the second closure element 434. In the preferred embodiment, the first closure element 432 includes a flap 433 and a tab 435 and the second closure element 434 includes a slot. Accordingly, in order to retain the package 400 in the closed position, the tab is inserted within the slot. As in the previously described embodiments, the closure is located along an end of the package thereby leaving essentially uninterrupted front 402 and back 404 surfaces on which indicia 437 may be placed.

Figure 15:
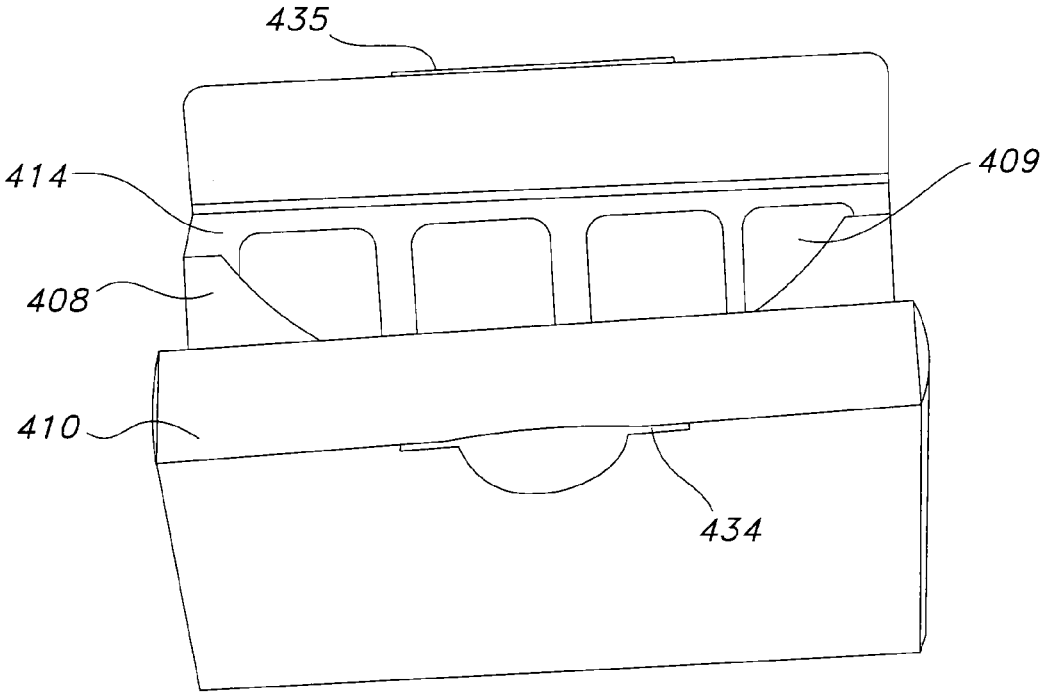
FIG. 15 is a perspective view of the package of FIG. 13 shown in the partially open position.

In order to open the package 400, if an outer over-wrap is used, it may first be removed for the initial opening of the package. The flap 433 is then rotated such that the first and second closure elements disengage each other as shown in FIG. 14. The compartment 408 may then be rotated out of the cover 410 as shown in FIG. 15. When the package is fully open as shown in FIG. 16, product 409 may be removed from the compartment 408.

The present embodiment may be formed of one or more pieces of a foldable material such as paperboard. The material may be folded and various sections may be secured together such as by an adhesive in a manner known in the art.

Figure 17:
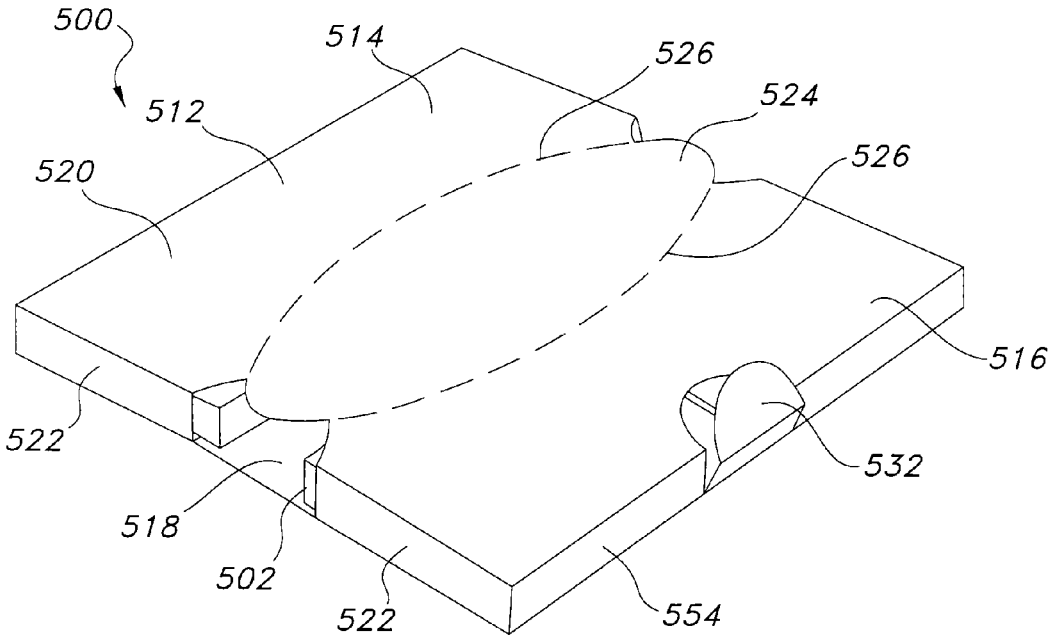
FIG. 17 is a perspective view of a further alternative embodiment of a package of the present invention.

A further alternative embodiment is shown in FIGS. 17-22. Referring to FIG. 17, the present invention relates to a package 500 for comestibles product 502 including a package housing 512. The package housing includes a first compartment 514 and a second compartment 516 for holding the product 502. The package housing 512 has an initial closed position wherein the package is not yet opened by a user. In this initial position, the compartments are aligned in the same plane, and the package is relatively flat as shown in FIG. 17. The package housing 512 may have a second closed position (FIG. 21) wherein the first 514 and second 516 compartments are folded against each other such that they overlap to create a more compact configuration.

Figure 20:
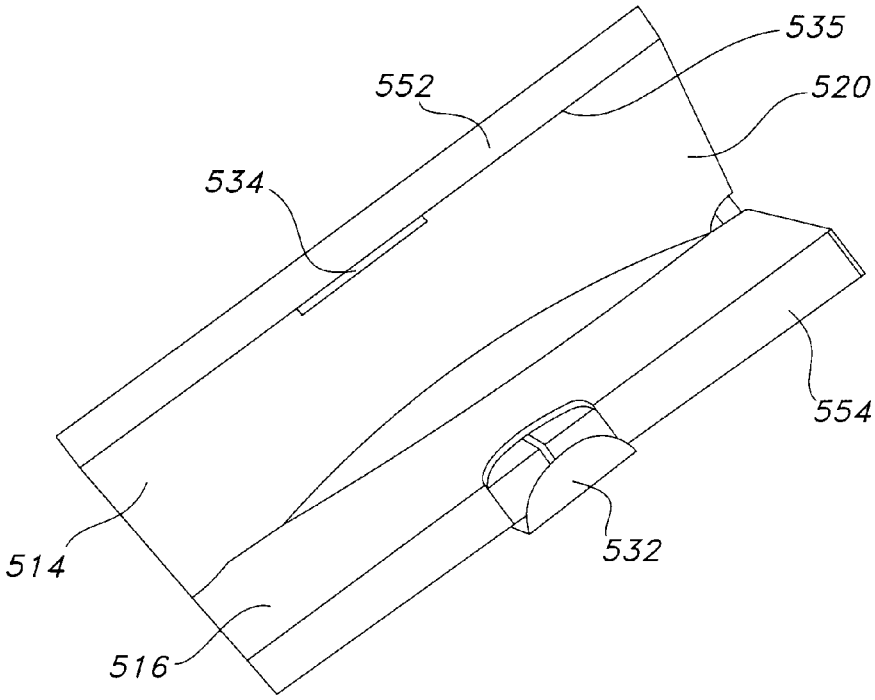
FIG. 20 is a perspective view of the package of FIG. 17 shown being moved to a closed position.

With specific reference to FIGS. 17 and 20, in the initial position, the package 500 has a front wall 518 and a back wall 520. Opposed side walls 522 and a first 552 and second 554 end wall adjoin the front wall 518 to the back wall 520. The front wall 518 is relatively smooth and uninterrupted. The back wall 520 is smooth and preferably includes a removable tab 524 extending along the width of the package housing 512. The removable tab 524 may be connected to the adjoining portions of the back wall by perforation lines 526 or other frangible structures. The removable tab 524 may have an oval shape; however, it is within the contemplation of the present invention that other shapes may be used. The removable tab 524 preferably extends between the first and second compartments 514, 516. In the initial closed position, the first and second compartments 514, 516 lie in a common plane and the package 500 has a generally planar configuration. The first compartment 514 is offset from the second compartment 516 along a length of the front 518 or back 520 walls and the removable tab 524 extends transverse to the length when in the initial closed position.

The package housing 512 may be covered by a plastic over-wrap (not shown) of a type known in the art, which is removable by a user prior to dispensing the comestibles.

Figure 18:
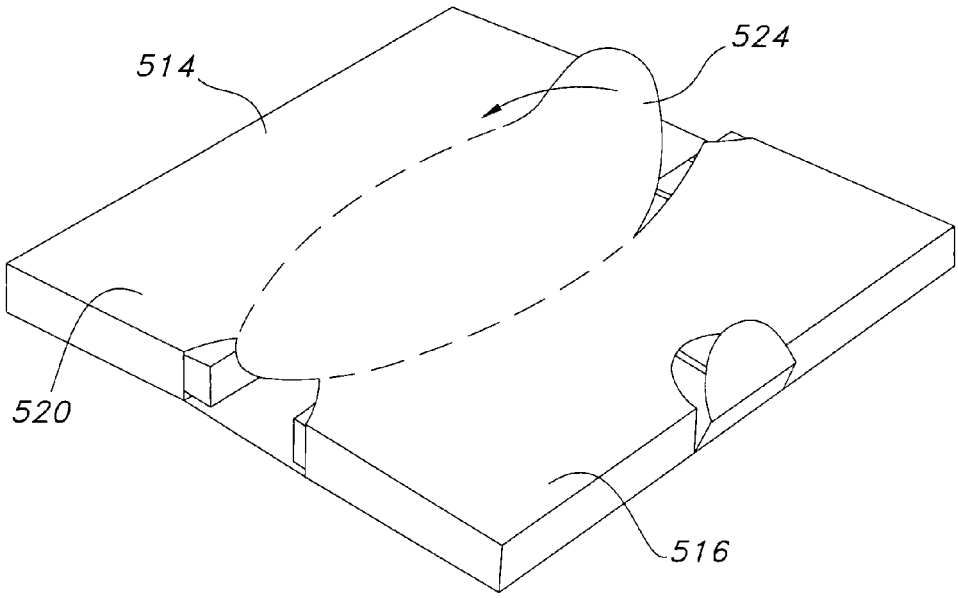
FIG. 18 is a perspective view of the package of FIG. 17 with a center tab partially removed.
Figure 19:
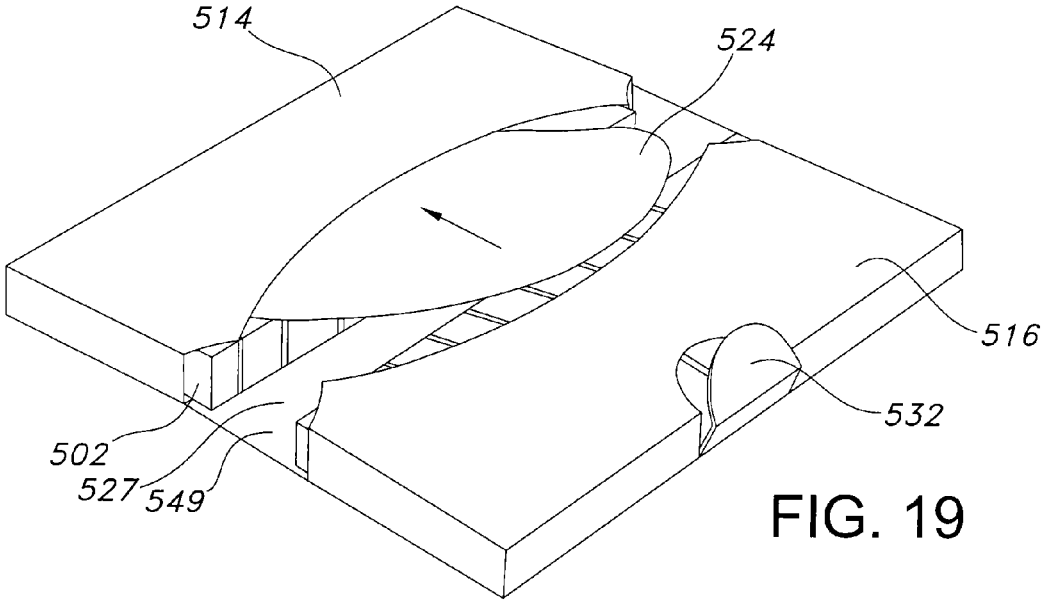
FIG. 19 is a perspective view of the package of FIG. 17 with the center tab being inserted for storage.

When it is desired to open the package housing 512, a user may grab one end of the removable tab 524 and tear the removable tab from the back wall 520, as shown in FIG. 18. The tab 524 is then separated from the package housing 512. The tab 524 may then be discarded or inserted into one of the comestible compartments 514, 516 as shown in FIG. 19. Removing the tab 524 creates an opening 527 in the package housing 512 and exposes the comestibles 502 inside. The comestibles 502 may include pieces of wrapped or unwrapped gum which may be formed as slabs or other shapes. A user may then remove one of the comestible pieces 502. The pieces may be removably secured to the compartments 514, 516 by an adhesive or other manner as known in the art.

Figure 21:
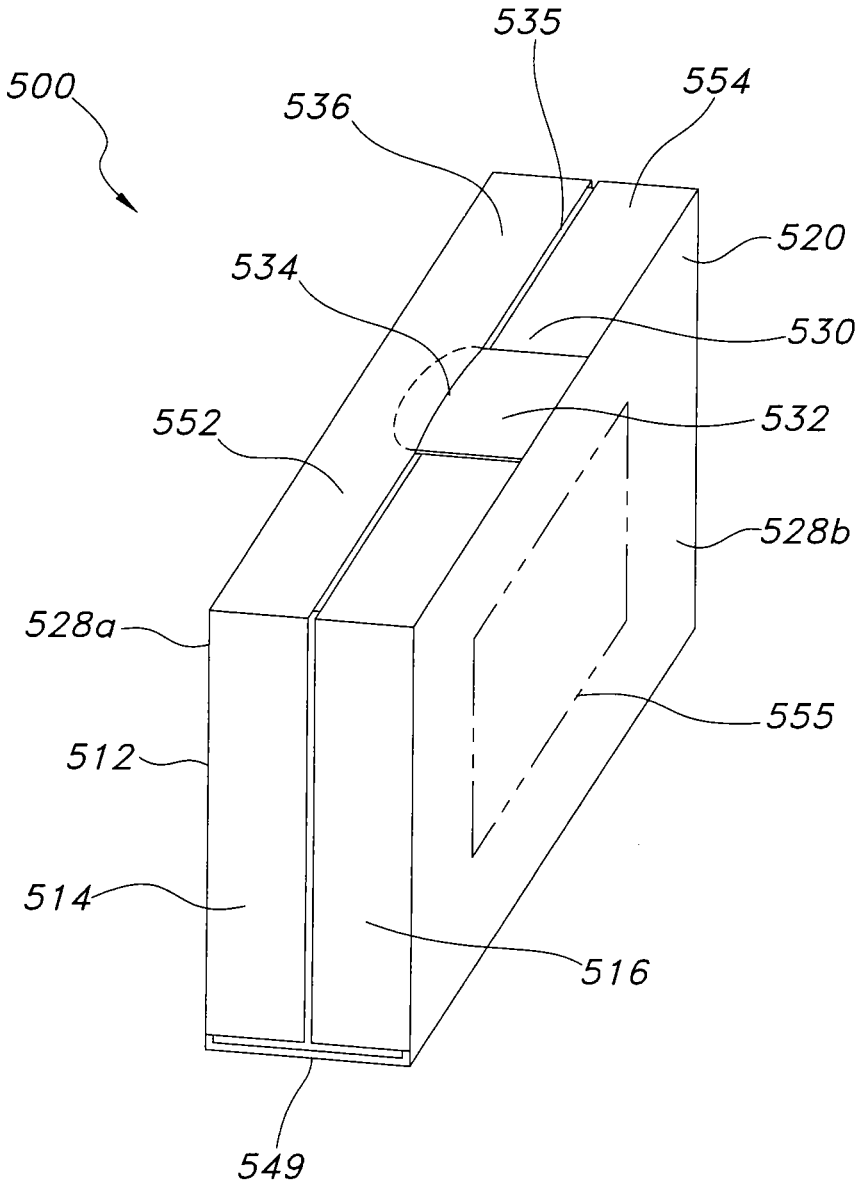
FIG. 21 is a perspective view of the package of FIG. 17 shown in the closed position.

The removable tab 524 when in position maintains the integrity of the back wall 520, therefore, the front and back walls generally prevent the compartments from rotating with respect to each other. When the tab 524 is removed, the back wall 520 is separated into two separate wall parts and the package 500 may be rotated along the back wall portion such that the first and second compartments 514, 516 may be rotated toward each other. With reference to FIGS. 20 and 21, in order to close the package housing 512, the first and second compartments 514 and 516 may be folded over one another, in a manner similar to closing a book such that the compartments overlap each other. Each of the first and second compartment 514 and 516 acts as a cover for the other thereby retaining the product within the compartments. The first and second compartments assume a generally parallel opposed relationship when in the closed position such that the comestibles 502 are retained in the package housing 512.

The first and second compartments 514 and 516, may be held in the closed position by a closure 530. Closure 530 may include a first closure member 532 integrally formed in the end of either of the first or second holders, 514 and 516. The other comestible holder may include a second closure member 534 which cooperates with the first closure member to secure the package housing 512 in the closed position. In the preferred embodiment, the first closure 532 member may include a tab and the second closure member 534 may include a slot that is sized and positioned for receiving the tab. When a user inserts the tab 532 into slot 534, the interference between the two structures retains the package housing 512 in the closed position. In a preferred embodiment, the slot 534 may be disposed at, or adjacent to, the junction 535 between the back wall 520 and first end wall 552. Alternatively, the slot could be formed entirely in bottom wall 552. Therefore, in the folded closed position, the closure 530 is disposed on the bottom edge 536 of the package housing 512. Accordingly, when in the closed position, the closed package front 528*a* and back 528*b* sides provide uninterrupted surfaces upon which indicia 555 may be placed.

When the user desires to reopen the package housing, the tab 532 may be removed from slot 534 and the first and second comestible holders 514 and 516 rotated away from each other. Access to the comestibles 502 is again possible.

In the initial position shown in FIG. 17, the front wall 518 and back wall 520 of the package housing present two relatively large surfaces onto which indicia conducive to sales and marketing can be printed. Large printing and images may be used in order to attract the attention of potential buyers of the product. In the closed position (FIG. 21), the package is compactly folded so that it is easy for a user to carry and store.

Figure 22:
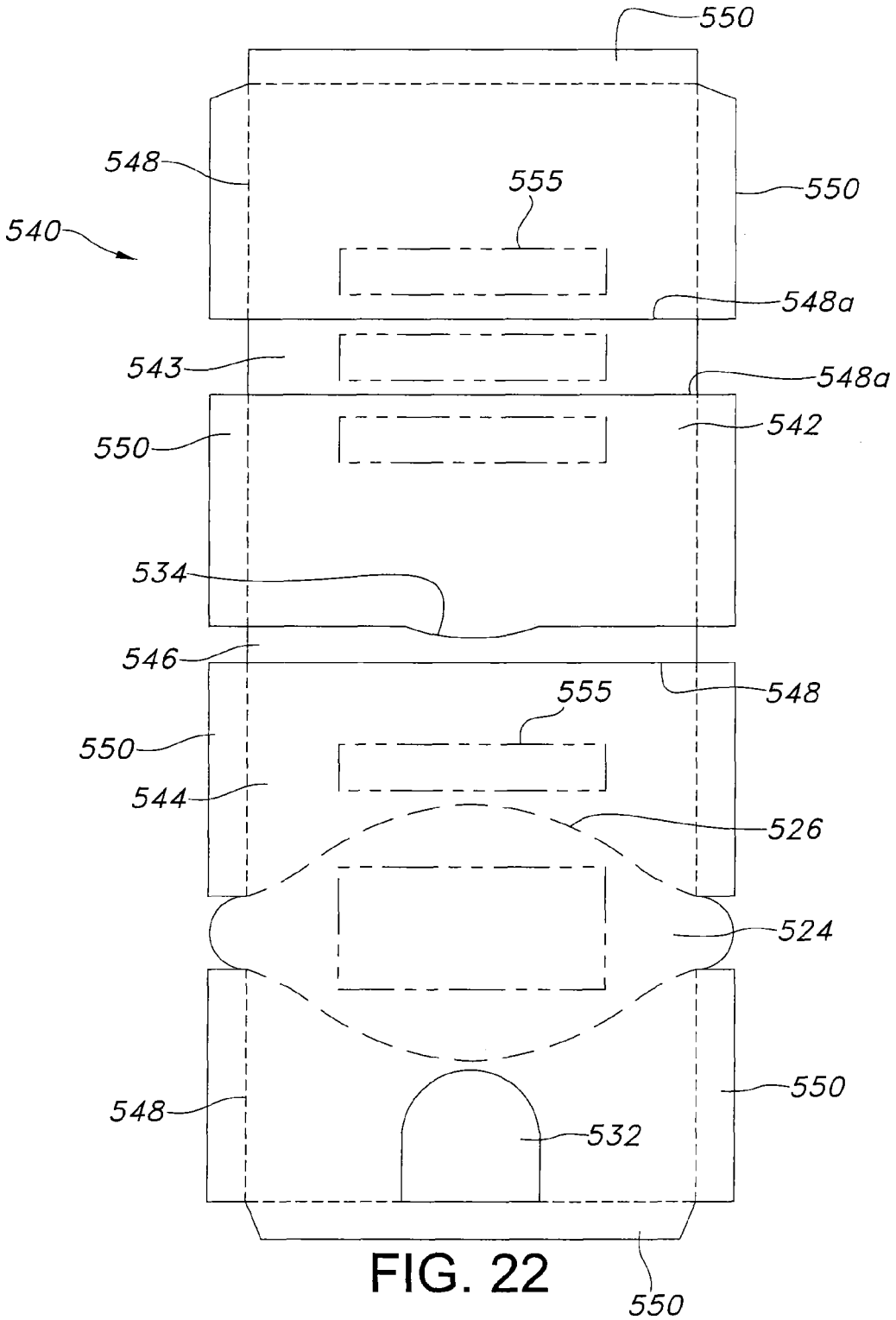
FIG. 22 is a top plan view of a blank used to form the package of FIG. 17.

With reference to FIG. 22 the package housing 512 may be formed of a single unitary piece of material which is cut to the desired configuration in the form of a blank 540. It is also within the contemplation of the present invention that the package housing 512 may be formed of a plurality of pieces secured together by adhesive or other fastening means. The blank 540 may be constructed of a single piece of paperboard. Alternatively, other foldable material could also be employed to form the blank 540. Blank 540 includes a front panel 542 and a back panel 544 which are connected by an end panel 546. The various panels may be separated by fold lines 548 formed in the blank 540 which assist in the forming of the package housing 512.

Back panel 544 includes the removable tab 524 extending across its width. The tab 524 is connected to the rest of the back panel by a frangible portion such as a perforation line 526. Back panel 544 may also include closure tab 532 formed therein. Slot 534 may be cut in front panel 542 adjacent end panel 546. The front panel 542 may include a hinge panel 543 defined by spaced fold lines 548*a*. The hinge panel 543 forms the hinged spine 549 of the package housing 512 when in the closed position shown in FIG. 21. A crease or fold line (not shown) may be formed in panel 543.

To form the package housing 512, the front panel 542 may be folded over the back panel 544. A plurality of securement tabs 550 extend from the front and back panels. When the front 542 and back 544 panels are folded together, the securement tabs 550 are brought together. The adjacent securement tabs 550 may then be secured together by an adhesive or by other known securement methods. Referring to FIGS. 17 and 20, the securement tabs 550 form the package housing side walls 522 and the second package housing end wall 554. The first end wall 552 of the package housing is formed by end panel 546. The product 502 may be inserted into the package prior to the securement tabs being joined together.

The package housing 512 may remain in the initial position wherein the compartments are coplanar such that broad front and back surfaces are provided to include indicia to assist in marketing and sales. Once the package is opened by a user to access the product held in the first and second compartments 514 and 516, the package 500 may be folded to the closed position after removal of tab 524 such that it may be conveniently stored.

Having described the preferred embodiments herein, it should now be appreciated that variations may be made thereto without departing from the contemplated scope of the invention. Accordingly, the preferred embodiments described herein are deemed illustrative rather than limiting the true scope of the invention being set forth in the claims appended hereto.

What is claimed is:

1. A package comprising:

a first compartment for holding one or more product pieces and having a first package wall spaced from a second package wall and connected thereto by an end wall, the first compartment having an opening;

a second compartment for holding one or more product pieces and separably secured to a first compartment bottom wall with a connecting flap, the second compartment being rotatable with respect to the first compartment and having a first position wherein the second compartment overlies the first compartment and a second position wherein the second compartment extends outwardly from the first compartment;

a cover extending from the first compartment and a top of the package and movable between an open and closed position to selectively cover and uncover the first and second compartments; and a first slot disposed at a first fold line between the first compartment bottom wall and the first package wall, and a second slot disposed at a second fold line between the connecting flap and the second compartment and positioned at a package bottom, the second slot retaining the cover in the closed position and the cover extends to the package bottom and entirely overlies the second compartment providing a smooth and uninterrupted package surface when the second compartment is in the first position, and the first slot retaining the cover in the closed position when the second compartment is separated from the first compartment, and the cover extends to the package bottom and entirely overlies the first compartment providing a smooth and uninterrupted package surface.

2. The package as defined in claim 1, wherein the cover includes a tab extending from a distal end of the cover and is receivable in the first and second slots.

3. The package as defined in claim 1, wherein the first compartment and second compartment are constructed of separate pieces of material.

4. The package as defined in claim 1, wherein the cover extends from the first package wall.

5. The package as defined in claim 1, wherein the second compartment is separable from the first compartment along the connecting flap, and the cover is securable to the first slot when the second compartment is separated from the first compartment.

6. The package as defined in claim 1, wherein the first slot is disposed at one edge of the connecting flap and the second slot is disposed at an opposed edge of the connecting flap.

7. The package as defined in claim 1, wherein the second compartment has an opening, and the second slot is disposed adjacent the second compartment opening.

8. The package as defined in claim 1, wherein the cover has a leading edge and a tab insertable in the first and second slots extending from the leading edge, and the leading edge aligns with a length of the package bottom when the cover is in the closed position.

9. A package for containing one or more pieces of a comestible product, comprising:

a first compartment and a second compartment, each compartment being formed to receive and contain one or more individual pieces of the comestible product, the first compartment being separably joined to the second compartment by a connecting flap disposed at a package bottom;

the first compartment being at least partially enclosed on five sides thereof, including a back wall, a front wall, a bottom wall, and a pair of lateral side walls; and the second compartment being at least partially enclosed on five sides thereof, including a back wall, a front wall, a bottom wall, and a pair of lateral side walls, the second compartment having a first position overlying the first compartment and a second position extending outwardly from the first compartment; and a cover flap connected to the back wall of the first compartment; and when the second compartment is in the first position, the cover flap is selectably engagable with a first receiving slot located at a fold line between the connecting flap and the second compartment and the cover flap extends all the way to the package bottom creating a smooth uninterrupted front package surface, and when the second compartment is separated from the first compartment, the cover flap is selectably engagable with a second receiving slot located at a fold line between the bottom wall and the front wall of the first compartment wherein the cover flap extends all the way to the package bottom creating a smooth uninterrupted front package surface.

10. The package as defined in claim 9, wherein the cover flap substantially covers the entire second compartment back wall when the cover flap is in a closed position.

11. The package as defined in claim 9, wherein the first receiving slot is disposed at one edge of the connecting flap and the second receiving slot is disposed at an opposed edge of the connecting flap.

12. The package as defined in claim 9, wherein the second compartment has an opening, and the second receiving slot is disposed adjacent the second compartment opening.

13. The package as defined in claim 9, wherein the cover flap has a leading edge and a tab insertable in the first and second receiving slots extending from the leading edge, and the leading edge aligns with a length of the package bottom when the cover flap is in the closed position.

* * * * *